US006439023B1

(12) United States Patent
Nickell

(10) Patent No.: US 6,439,023 B1
(45) Date of Patent: Aug. 27, 2002

(54) METHODS AND APPARATUS FOR RETROFITTING COMPRESSIBLE FLANGES

(75) Inventor: James Terrell Nickell, Lebanon, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/715,326

(22) Filed: Nov. 17, 2000

Related U.S. Application Data

(60) Provisional application No. 60/191,157, filed on Mar. 22, 2000.

(51) Int. Cl.[7] ..... B21D 3/14
(52) U.S. Cl. ..... 72/393
(58) Field of Search ..... 72/393

(56) References Cited

U.S. PATENT DOCUMENTS 1,418,721 A * 6/1922 Larson ..... 72/393
2,999,529 A * 9/1961 Rast ..... 72/393
4,198,844 A * 4/1980 Lowe et al. ..... 72/393
4,735,078 A * 4/1988 Wesebaum ..... 72/393
4,767,276 A 8/1988 Barnes et al.
5,076,591 A 12/1991 Gentile
5,172,942 A 12/1992 Dillmann
5,470,114 A 11/1995 Umney et al.
6,145,843 A 11/2000 Hwang

* cited by examiner

*Primary Examiner*—Lowell A. Larson
(74) *Attorney, Agent, or Firm*—Nathan D. Herkamp; Armstrong Teasdale LLP

(57) ABSTRACT

A bend die assembly retrofits compressible flanges to permit the flanges to be reinstalled around tubes to form a sealing contact. The bend die assembly includes a base and a bend die. The base includes a first body portion that couples to a second body portion to define a cavity. The bend die includes a base portion, a body portion, and a head portion, and is received within the base cavity. The bend die head portion receives the compressible flange and includes a plurality of expandable segments contoured to substantially conform to a contour of the compressible seal.

19 Claims, 3 Drawing Sheets

METHODS AND APPARATUS FOR RETROFITTING COMPRESSIBLE FLANGES

CROSS REFERENCE TO RELATED APPLICATION

This application claims the benefit of U.S. Provisional Application No. 60/191,157, filed Mar. 22, 2000.

BACKGROUND OF THE INVENTION

This invention relates generally to gas turbine engines and, more particularly, to gas turbine engines including compressible flanges.

Gas turbine engine bleed air systems typically include a plurality of tubes connected with tube couplings. Because adverse operation of the bleed air system may reduce an efficiency of the gas turbine engine, typically such tube couplings are multi-piece assemblies that couple to provide a substantially leak-proof assembly.

Known tube couplings include a flange assembly including a pair of mating flanges, and a clamping band used to tighten the two mating flanges. The mating flanges include a compressible or crushable flange fabricated from a material that permits the compressible flange to deform when the clamping band is tightened to form a sealing contact. Because of the clamping force applied to ensure the sealing contact is formed, elastic limits of the compressible flange material often are exceeded and the compressible flange may deform. Thus, if the coupling is disassembled, the compressible flange may need repair to restore a suitable sealing surface.

Manual cold-working techniques that force the flange into alignment using a combination of a vise, a pry bar, a flat plate, and a hammer typically are used to restore compressible seals. The restoration process is time-consuming and often the cold-working causes local stress concentrations to develop within the flanges. Over time, the stress concentrations may cause cracks to develop within the flanges which warrant the replacement of the flange.

Other known techniques of repairing compressible seals include cutting the deformed flange from the coupling and welding a replacement flange to the deformed flange. Such cutting and welding operations are also time-consuming and labor intensive.

BRIEF SUMMARY OF THE INVENTION

In an exemplary embodiment, a bend die assembly retrofits compressible flanges to permit the flanges to be reinstalled around tubes to form a sealing contact. The bend die assembly includes a base and a bend die. The base includes a first body portion coupled to a second body portion to define a cavity. The bend die includes a base portion, a body portion, and a head portion, and is secured within the bend die assembly cavity after the bend die assembly first and second body portions are coupled. The bend die head portion receives the compressible flange and includes a plurality of segments that are expandable radially outwardly and are contoured to substantially conform to a contour of the compressible flange.

In use, the compressible flange is attached to the bend die assembly such that the bend die head portion is received within the compressible flange and the bend die body portion aligns the flange with respect to the bend die assembly. The bend die head portion segments are then forced radially outward to contact the compressible seal. As the bend die head portion segments contact the compressible seal, the seal is retrofitted, such that the compressible flange may be re-installed around a tube for sealing contact.

DETAILED DESCRIPTION OF THE INVENTION

Figure 1:
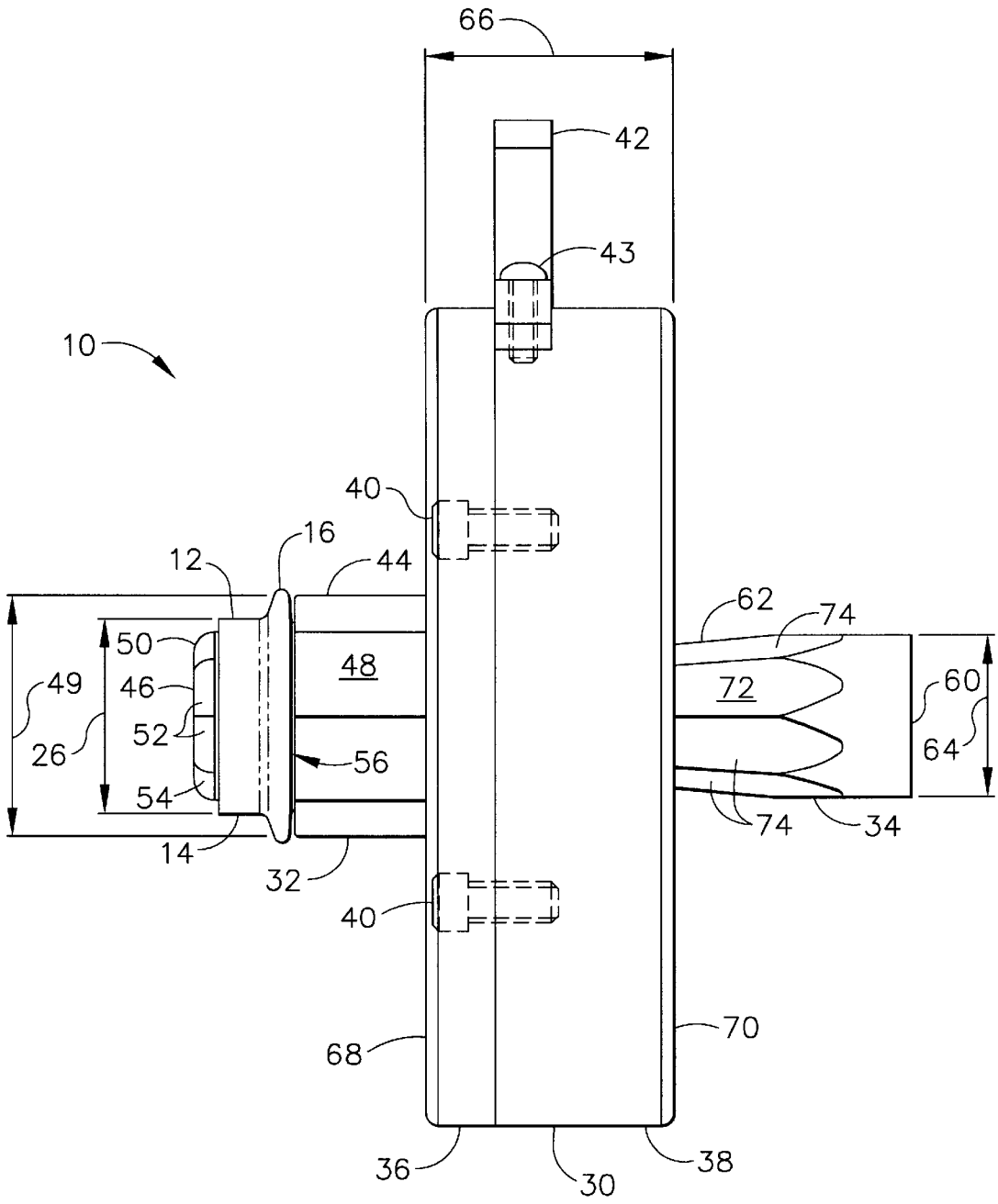
FIG. 1 is side elevational view of a bend die assembly for retrofitting an attached compressible seal.
Figure 2:
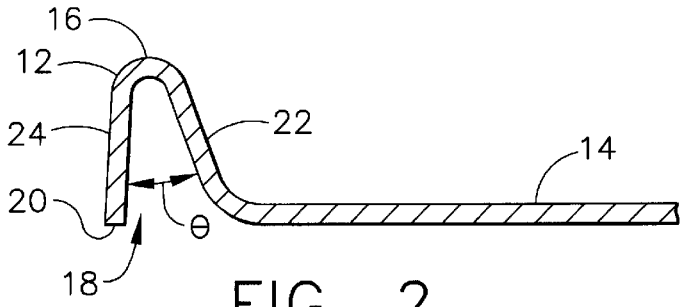
FIG. 2 is a cross-sectional view of the compressible flange shown being retrofitted in FIG. 1.

FIG. 1 is side elevational view of a bend die assembly 10 for retrofitting an attached compressible flange or seal 12. FIG. 2 is a cross-sectional view of compressible flange 12. Compressible flange 12 is known in the art and includes a first body portion 14 and a second body portion 16 extending from first body portion 16. More specifically, seal first body portion 14 extends from a first end (not shown) of seal 12 to seal second body portion 16, and second body portion 16 is contoured to form a channel 18 that extends radially outward between first body portion 14 and a second end 20 of seal 12. In the exemplary embodiment, compressible flange 12 is a v-band flange.

Seal channel 18 is defined by a first leg 22 and a second leg 24. First leg 22 extends from seal first body portion 14 to second leg 24. An inner contour angle □ is defined between legs 22 and 24. After seal 12 is retrofitted with bend die assembly 10, angle □ is compressed such that seal channel second leg 24 is substantially perpendicular with respect to seal first body portion 14.

Compressible flange first body portion 14 defines an inner diameter 26 that is selected to permit seal 12 to extend circumferentially around a tube (not shown) for sealing purposes. Sealing occurs between compressible flange 12 and the tube when a clamping force is applied circumferentially around compressible flange 12 and seal second body portion 16 is forcibly crushed and retained against the tube for sealing contact.

Bend die assembly 10 includes a body 30, a bend die 32, and a shaft 34, and is used to retrofit compressible seals 12 such that seals 12 that are deformed during assembly may be used to restore a suitable seal against a tube. Bend die assembly body 30 includes a first body portion 36 and a second body portion 38. Bend die assembly first body portion 36 is coupled to assembly second body portion 38 with a plurality of fasteners 40 that extend through assembly first body portion 36 into assembly second body portion 38. Bend die assembly first body portion 36 couples to bend die assembly second body portion 38 to define a cavity (not shown in FIG. 1).

A lifting handle 42 is secured to bend die assembly second body portion 38 with a plurality of fasteners 43. Lifting handle 42 permits bend die assembly 10 to be easily carried between locations.

Bend die 32 includes a base portion (not shown in FIG. 1), a body portion 44, and a head 46. The bend die base portion is sized to be received within the bend die assembly body cavity and secures bend die 32 within bend die assembly 10 when bend die assembly first body portion 36 is coupled to bend die assembly second body portion 38. The bend die base portion extends from a first end (not shown in FIG. 1) of bend die 32 to bend die body portion 44.

Bend die body portion 44 extends between the bend die base portion and bend die head 46, and includes an outer surface 48. Bend die body portion 44 is substantially cylindrical and extends substantially perpendicularly from the bend die base portion and from bend die assembly body 30. Outer surface 48 defines a width 49 of bend die body portion 44 that is smaller than a width (not shown in FIG. 1) of the bend die assembly body cavity. In the exemplary embodiment, bend die body portion outer surface 48 also defines a substantially octagonally-shaped cross-sectional profile for bend die body portion 44. Bend die body portion width 49 is larger than seal first body portion inner diameter 26.

Bend die head 46 extends from bend die body portion 44 and tapers at a second end 50 of bend die 32. Bend die head 46 is formed from a plurality of segments 52 that extend longitudinally from bend die second end 50 to bend die body portion 44. In one embodiment, bend die head 46 has a substantially octagonally-shaped cross-shaped cross-sectional profile and includes eight segments 52. More specifically, segments 52 extend from a first end 54 adjacent bend die second end 50 to a second end (not shown in FIG. 1) adjacent bend die body portion 44.

Segment first ends 54 are hinged to an end cap (not shown in FIG. 1). Because segments 52 are only secured to bend die head 46 at segment first ends 54, segments 52 may expand radially outwardly from bend die head 46 and contact an attached compressible flange 12. Each segment 52 includes a shoulder (not shown in FIG. 1) adjacent segment second end 56. Each segment shoulder is contoured to have a shape that substantially matches an inner contour of compressible flange channel 18 defined by compressible flange inner contour angle □.

Shaft 34 has a first end (not shown in FIG. 1), a second end 60, and a body 62 extending therebetween. Shaft body 62 is tapered from shaft second end 60 towards the shaft first end, such that a width 64 of shaft body 62 at shaft second end 60 is larger than a width (not shown in FIG. 1) of shaft body 62 at the shaft first end.

Shaft body 62 has a length (not shown in FIG. 1) that is longer than a width 66 of bend die assembly body 30. Bend die assembly body width 66 is measured between an outer surface 68 of bend die assembly first body portion 36 and an outer surface 70 of bend die assembly second body portion 38.

Shaft body 62 also includes an outer surface 72 including a plurality of segments 74 that extend taper longitudinally from the shaft body first end towards shaft body second end 60. In one embodiment, shaft body 62 has a substantially octagonally-shaped cross-shaped cross-sectional profile and includes eight segments 74.

Figure 4:
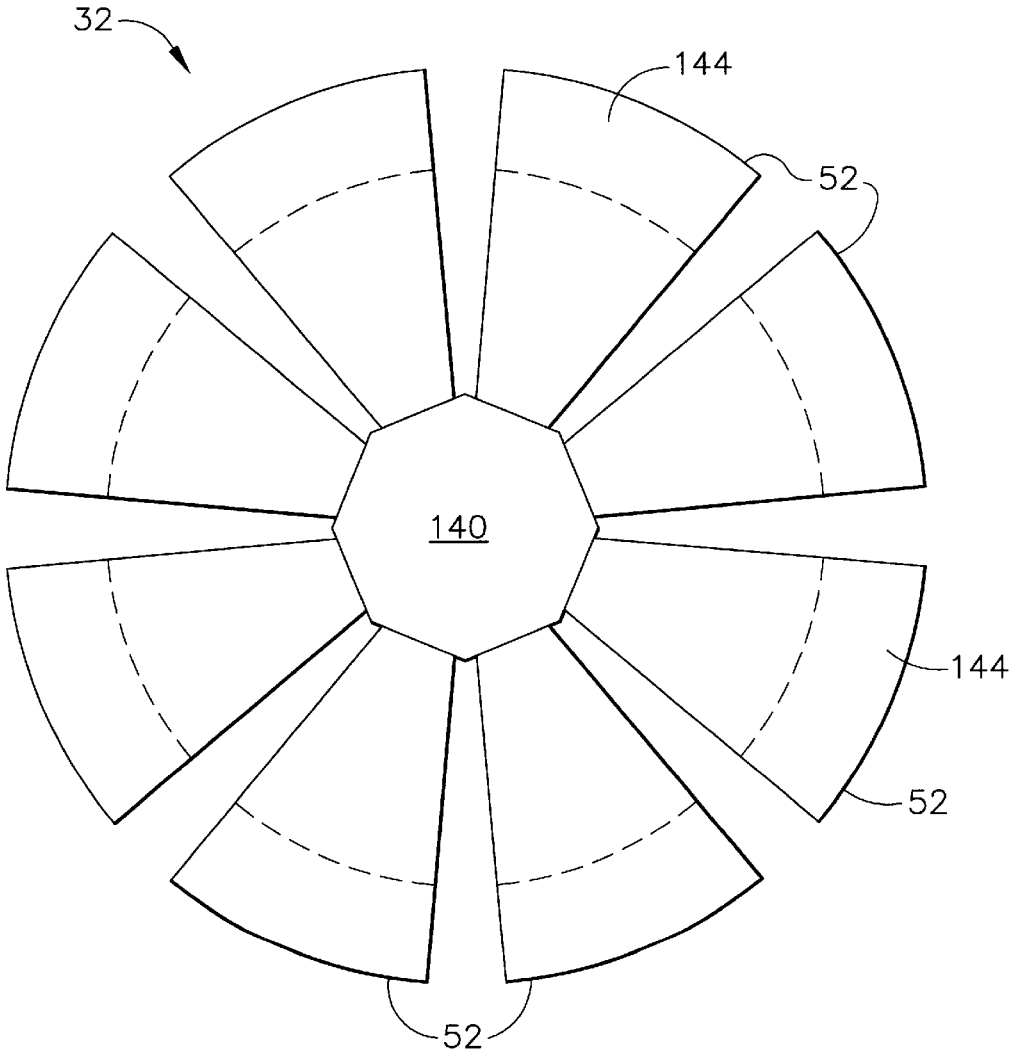
FIG. 4 is a front view of a bend die used with the bend die assembly shown in FIG. 1.
Figure 3:
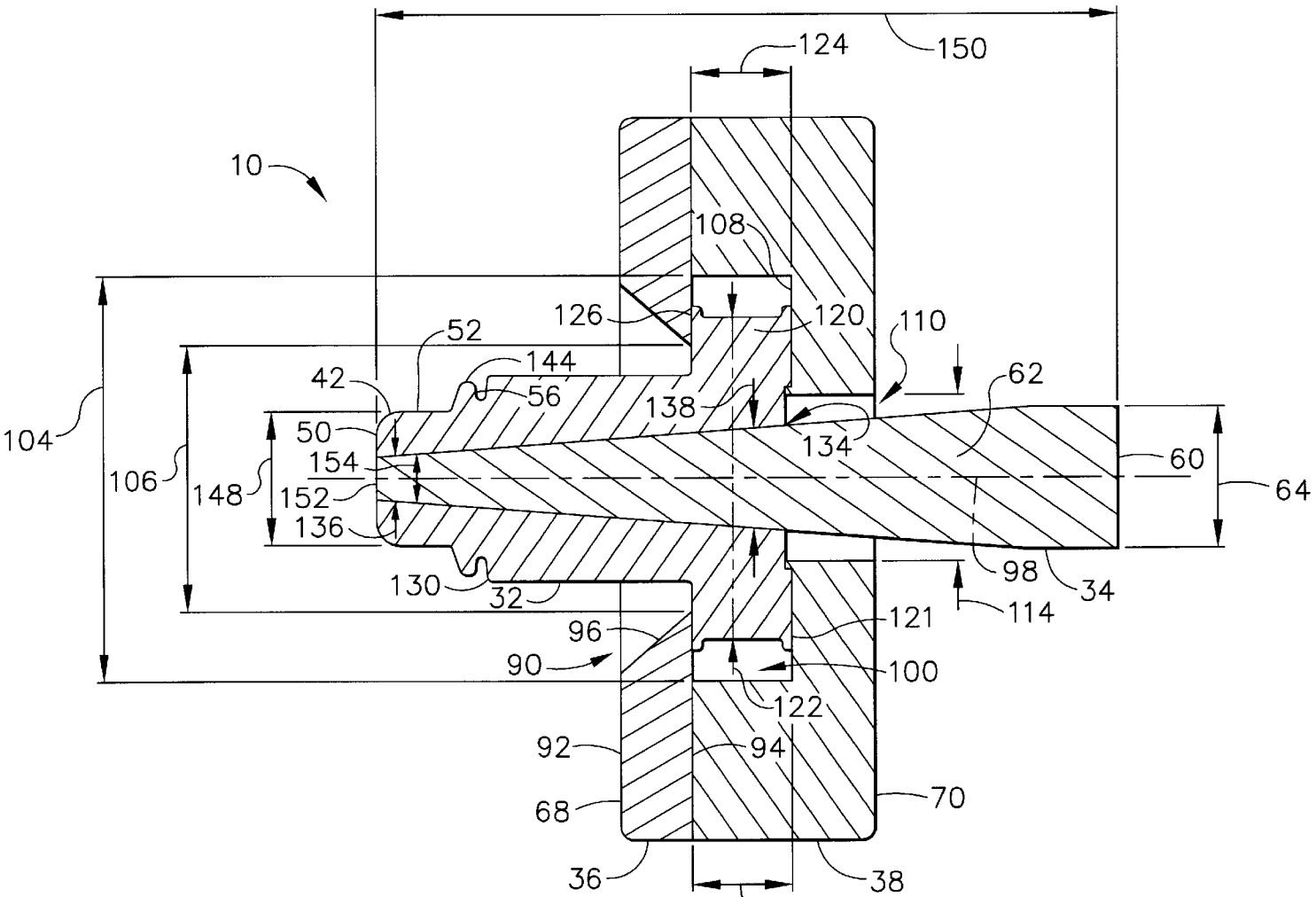
FIG. 3 is a cross-sectional view of the bend die assembly shown in FIG. 1.

FIG. 3 is a cross-sectional view of bend die assembly 10 including bend die 32, and FIG. 4 is a front view of an expanded bend die 32. Bend die assembly body 30 includes first and second body portions 36 and 38, respectively. Bend die assembly first body portion 36 includes an opening 90 that extends from bend die assembly first body portion outer surface 68 to an inner surface 94 of bend die assembly first body portion 36. In one embodiment, opening 90 has a substantially circular cross-sectional profile. Opening 90 tapers between first body portion outer and inner surfaces 92 and 94, respectively, such that an opening sidewall 96 extends angularly with respect to a center axis of symmetry 98 of bend die assembly 10.

Bend die assembly first and second body portions 36 and 38 respectively, couple with fasteners 40 (shown in FIG. 1) to define a cavity 100. Cavity 100 has a diameter 104 that is larger than a diameter 106 of bend die assembly first body portion opening 90. Furthermore, cavity 100 has a height 107 that extends from an inner surface 108 of bend die assembly second body portion 38 to bend die assembly first body portion inner surface 94.

Bend die assembly second body portion 38 includes an opening 110 that extends from bend die assembly second body portion inner surface 108 to bend die assembly second body portion outer surface 70. In one embodiment, opening 110 has a substantially circular cross-sectional profile. Opening 110 has a diameter 114 that is smaller than cavity diameter 104 and bend die assembly first body portion opening diameter 106.

Bend die 32 includes a base portion 120 that extends from a first end 121 of bend die 32, and has a width 122 and a height 124. Bend die base portion width 122 is smaller than bend die assembly cavity width 104, but larger than bend die first body portion opening diameter 106. Bend die base portion height 124 is approximately the same size as bend die assembly cavity height 107. When bend die 32 is received within cavity 100, a portion 126 of bend die assembly first body portion 36 contacts bend die base portion 120 to secure bend die 32 within cavity 100.

Bend die body portion 44 extends from bend die base portion 120 to a backstop 130. Body portion backstop 130 is substantially perpendicular to bend die assembly axis of symmetry 98 and is between bend die base portion 120 and bend die head 46. More specifically, backstop 130 is between bend base portion 120 and bend die head segment second end 56.

Bend die 32 also includes an opening 134 extending between bend die first and second ends 121 and 50, respectively. Opening 134 is tapered such that a diameter 136 of opening 134 adjacent bend die second end 50 is smaller than a diameter 138 of opening 134 adjacent bend die first end 121.

Bend die head segments 52 circumferentially extend over bend die head 46 from an end cap 140. When expanded, as shown in FIG. 4, bend die head segments 52 extend radially outward, such that adjacent segments 52 are not in contact. Each bend die segment 52 includes a shoulder 144 adjacent bend die segment second end 56. Each shoulder 144 extends radially outward from bend die head 46 and is contoured to substantially conform to an inner contour of compressible flange channel 18 defined by compressible flange inner contour angle □.

When unexpanded, adjacent bend die head segments contact each other and extend circumferentially around bend die head 46. Unexpanded segments 52 define a width 148 of bend die head 46 that is smaller than seal inner diameter 26.

Bend die assembly shaft body 62 has a length 150 extending between a first end 152 of shaft 34 and shaft second end 60. Shaft length 150 is longer than bend die assembly body 30 width. Shaft body 62 is tapered to substantially conform to the taper of bend die opening 134. Accordingly, a width 154 of shaft body 62 adjacent shaft first end 152 is smaller than shaft body width 64 adjacent shaft second end 60.

During retrofitting of compressible seals 12 (shown in FIG. 1), a seal 12 is attached to bend die assembly 10 such that bend die assembly 10 is received within seal 12. More specifically, bend die head 46 is inserted within compressible flange 12 such that seal second body portion channel 18 (shown in FIG. 2) is positioned circumferentially radially outward from bend die head segment shoulders 144, and seal first body portion 14 is circumferentially radially outward from bend die head segments 52. Accordingly, a bend die 32 is selected to enable bend die head 46 to be received within seal 12. Bend die assembly body portion backstop 130 limits an amount of bend die assembly 10 that is inserted within compressible flange 12 and aligns seal 12 with respect to bend die head 46.

After seal 12 is aligned with respect to bend die assembly 10, bend die assembly shaft 34 is transitioned longitudinally within bend die opening 134 through bend die head 46. As shaft body tapered segments 74 progress through bend die opening 134, shaft segments 74 contact bend die head 46 and expand bend die head opening diameter 136 adjacent bend die second end 50, thus forcing bend die head segments 52 radially outward. As bend die head segments 52 expand radially outward, segments 52 uniformly contact compressible flange 12 to retrofit and reshape seal 12. More specifically, bend die segment shoulders 144 contact seal 12 within seal channel 18 and force seal channel first and second legs 22 and 24 to realign with respect to each other.

Because bend die assembly first and second body portions 36 and 38, respectively, are coupled, despite the force applied through bend die assembly shaft 32, bend die 32 is secured within bend die assembly cavity 100. After an initial amount of longitudinal force is applied to bend die assembly shaft 34, the application of force ceases, and seal 12 is rotated ninety degrees around bend die head 46, and the abovedescribed procedure is repeated. Rotating seal 12 eliminates a risk of bend die head segments 52 imparting parting lines on seal 12.

After several repetitions of the above-described procedure, seal 12 is retrofitted, such that seal 12 may form an effective seal with a tube. In one embodiment, seal 12 is retrofitted after several multiple engagements between bend die assembly 10 and seal 12, accompanied by rotation of seal 12 between subsequent engagements. More specifically, when retrofitted, seal channel inner contour angle □ is compressed such that seal channel leg 24 is substantially perpendicular with respect to seal first body portion 14 (shown in FIG. 2).

The above-described bend die assembly is cost-effective and highly reliable. The bend die assembly includes a replaceable bend die, a tapered shaft, and a two-piece bend die assembly body that includes a cavity sized to receive a plurality of bend dies of various widths. Each bend die includes a plurality of segment that are contoured to match a contour of the seals being retrofitted. As a tapered shaft engages the bend die assembly, the bend die segments are expanded radially outward to contact the compressible seal. As a result of the contact between the seal and the bend die segments, the compressible flange is retrofitted in a cost-effective and reliable manner such that the seal may be reinstalled around a tube for sealing purposes.

While the invention has been described in terms of various specific embodiments, those skilled in the art will recognize that the invention can be practiced with modification within the spirit and scope of the claims.

What is claimed is:

1. A method for retrofitting a compressible flange using a bend die assembly, the bend die assembly including a base and a bend die, said method comprising the steps of:

coupling the bend die to the base, wherein the bend die includes at least one expandable segment including a backstop and a contoured outer surface that includes at least one shoulder;

inserting the bend-die through an opening defined by an inner surface of the compressible seal, such that the stop limits a relative position of the bend-die with respect to each compressible seal; and expanding the bend-die to retrofit the compressible flange.

2. A method in accordance with claim 1 wherein the bend die assembly further includes a shaft, said method further comprising the step of inserting the bend die assembly shaft within the bend die.

3. A method in accordance with claim 2 wherein the bend die includes a plurality of segments, said step of expanding the bend die further comprising the step of contacting the compressible flange with the plurality of bend die segments.

4. A method in accordance with claim 2 wherein the bend die includes a plurality of segments, said step of expanding the bend die further comprising the step of inserting the shaft within the bend die such that the plurality of bend die segments expand radially outwardly and contact the compressible flange.

5. A method in accordance with claim 4 wherein the shaft includes a plurality of tapered segments, the plurality of bend die segments contoured, said step of inserting the shaft further comprising the step of inserting the shaft within the bend die such that the shaft tapered segments force the bend die contoured segments radially outward into contoured portions of the compressible flange.

6. An assembly for retrofitting compressible flanges comprising:

a base comprising an opening extending therethrough; and a bend die sub-assembly extending through said base opening, said bend die subassembly comprising a bend die comprising a first end, a second end, and a body extending therebetween, said bend die body comprising an outer surface and a plurality of segments configured to extend radially outward from said bend die body outer surface, each said segment comprising at least one shoulder and a backstop, said shoulder contoured to conform to an inner surface of the compressible flange, said backstop for limiting a relative position of said bend die sub-assembly with respect to each flange.

7. An assembly in accordance with claim 6 wherein said bend die body further comprises an opening extending from said bend die first end to said bend die second end.

8. An assembly in accordance with claim 6 wherein said bend die subassembly further comprises a shaft, said bend die body further comprises an opening extending from said bend die first end to said bend die second end, said bend die subassembly shaft inserted within said bend die body opening.

9. An assembly in accordance with claim 8 wherein said bend die subassembly shaft comprises a first end, a second end, and a plurality of segments extending longitudinally between said shaft first and second ends.

10. An assembly in accordance with claim 8 wherein said bend die shaft first end comprises a first width, said bend die shaft second end comprises a second width, said bend die shaft segments taper from said shaft first to said shaft second end such that said shaft first end first width smaller than said shaft second end second width.

11. An assembly in accordance with claim 6 wherein said bend die further comprises a backstop between said bend die segments and said bend die second end.

12. An assembly in accordance with claim 6 wherein said base comprises a first portion and a second portion, said base first portion removably coupled to said base second portion.

13. An assembly in accordance with claim 6 wherein said bend die segments contoured to match a contour of the compressible flanges.

14. A bend die assembly configured for use with retrofitting compressible flanges, each compressible flange having an inner width, said bend die assembly comprising:

a base; and a bend die coupled to said base and having a width smaller than the compressible flange inner width, said bend die comprising at least one expandable segment comprising a shoulder and a stop, said shoulder contoured to match a contour of each compressible flange, said backstop configured to position the compressible flange with respect to the bend die.

15. A bend die assembly in accordance with claim 14 wherein said bend die comprises a plurality of segments configured to extend radially outward from said bend die and contact the compressible flange.

16. A bend die assembly in accordance with claim 15 wherein said bend die segments tapered to conform to the compressible flange.

17. A bend die assembly in accordance with claim 15 wherein said bend die assembly further comprises a shaft partially inserted within said bend die, said shaft comprising a plurality of tapered segments.

18. A bend die assembly in accordance with claim 17 wherein said shaft configured to extend said bend die segments radially outward from said bend die.

19. A bend die assembly in accordance with claim 14 wherein said base comprises a first portion and a second portion, said first portion removably coupled to said second portion to couple said bend die to said base.

* * * * *